US008500117B2

(12) United States Patent
Uchida

(10) Patent No.: US 8,500,117 B2
(45) Date of Patent: Aug. 6, 2013

(54) SHEET FEEDING APPARATUS AND IMAGE FORMING APPARATUS WITH LOCKING PORTION PROVIDED IN THE CASSETTE BODY

(75) Inventor: Yasuhiro Uchida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/428,346

(22) Filed: Mar. 23, 2012

(65) Prior Publication Data

US 2012/0248692 A1 Oct. 4, 2012

(30) Foreign Application Priority Data

Mar. 30, 2011 (JP) ..... 2011-075730

(51) Int. Cl.
*B65H 1/08* (2006.01)

(52) U.S. Cl.
USPC ..... 271/127

(58) Field of Classification Search
USPC ..... 271/145, 127; 399/393
See application file for complete search history.

(56) References Cited

U.S. PATENT DOCUMENTS 3,097,760 A * 7/1963 Short ..... 271/155
4,763,891 A * 8/1988 Kodama ..... 271/127
5,228,676 A * 7/1993 Arai et al. ..... 271/126
5,700,006 A 12/1997 Sekiya et al.
5,765,826 A 6/1998 Isoda et al.
6,527,267 B1 3/2003 Kuwata et al.
6,643,480 B2 11/2003 Kuwata et al.
6,830,245 B2 12/2004 Matsushima et al.
6,871,848 B2 3/2005 Matsushima et al.
7,029,006 B2 4/2006 Izumi et al.
7,130,548 B2 10/2006 Uchida
7,681,877 B2 * 3/2010 Won ..... 271/127
7,971,868 B2 7/2011 Matsushima et al.
8,041,285 B2 10/2011 Hashimoto et al.
2010/0133743 A1 6/2010 Hamasaki et al.
2011/0024969 A1 2/2011 Matsushima et al.

FOREIGN PATENT DOCUMENTS

JP 06009070 A * 1/1994

* cited by examiner

*Primary Examiner* — Gerald McClain
(74) *Attorney, Agent, or Firm* — Fitzpatrick, Cella, Harper & Scinto

(57) ABSTRACT

A sheet cassette has a lock lever that engages a lock projection in an engagement portion of an stacking plate located in a lower position to enable the stacking plate to turn in a locked position in which the stacking plate is locked in a cassette body and an unlocked position in which the lock projection is separated from the engagement portion in lifting the stacking plate. In a state in which the sheet cassette is mounted on the apparatus body, the lifting and lowering device turns the lock lever to the unlocked position in lifting the stacking plate locked in the lower position by the lock lever.

12 Claims, 14 Drawing Sheets

SHEET FEEDING APPARATUS AND IMAGE FORMING APPARATUS WITH LOCKING PORTION PROVIDED IN THE CASSETTE BODY

BACKGROUND OF THE INVENTION

1. Field of the Invention

The present invention relates to a sheet feeding apparatus provided with a sheet cassette including a sheet stacking portion and an image forming apparatus provided with the sheet feeding apparatus.

2. Description of the Related Art

Frequently an image forming apparatus such as a copying machine, a FAX, and an LBP includes a sheet feeding apparatus that supplies a medium such as a cut sheet used to form an image to an image forming portion. Generally the sheet feeding apparatus includes a lifting and lowering device. In the lifting and lowering device, a stacking plate is provided as the sheet stacking portion in a sheet cassette, and the stacking plate is lifted and controlled in a position in which the sheet can be fed.

Generally a fixing member that fixes the stacking plate at a lowermost position is provided before shipping in order to prevent a breakage of the stacking plate or the lifting and lowering device due to a vibration of the stacking plate during shipment or movement of the apparatus. There is a possibility that a user drives the lifting and lowering device by turning on the power of the apparatus without removing the fixing member, which may lead to the breakage of the apparatus.

For example, U.S. Pat. No. 8,041,285 proposes a configuration in which the fixing member, which fixes a sheet loading plate that is of the stacking plate, is deformed by a lifting operation of the stacking plate with the lifting and lowering device, thereby automatically releasing the fixing of the sheet loading plate. In the configuration described in U.S. Pat. No. 8,041,285, a deformation member included in a mobile body retaining mechanism vertically downwardly abuts on part of the sheet loading plate, which can reciprocally moves within a movement range from a feeding position to a lower limit position, in the lower limit position. The deformation member is deformed such that the abutment on the sheet loading plate is released by a driving force from a lifting and lowering motor that lifts the sheet loading plate. The deformation member retracts to a position, in which the deformation member does not vertically downwardly abut on the sheet loading plate, by action of the driving force. The deformation member is fixedly supported in the lower limit position by a screw included in the mobile body retaining mechanism, and the deformation member is located in the position in which the deformation member does not vertically downwardly abut on the sheet loading plate. Therefore, even if the user forgets to remove the fixing member that restricts the movement of the sheet loading plate, the mobile body can normally be moved while the breakage is prevented.

However, in the related art, it is necessary to deform the fixing member in order to unlock the sheet loading plate that is of the stacking plate, and therefore the larger driving force is required for the lifting and lowering device. Therefore, it is necessary to use a motor that generates a torque equal to or more than necessary to lift and lower the stacking plate, which results in a problem of a cost increase or enlargement of the apparatus. In the related art, because the sheet loading plate cannot be locked again using the fixing member after the sheet loading plate is unlocked, the user cannot easily reuse the fixing member when moving the apparatus because of a move.

A sheet feeding apparatus and an image forming apparatus according to the present invention have a configuration in which the user can easily reuse the member, such as the fixing member, which is used in the locking while the motor having excessive performance is not used as the motor that lifts and lowers the stacking plate.

SUMMARY OF THE INVENTION

A sheet feeding apparatus includes a cassette body that is detachably attached to an apparatus body, a sheet stacking portion, provided in the cassette body, that supports sheets thereon, and the sheet stacking portion being able to perform a lifting and lowering operation, a sheet feeding portion that feeds the sheet stacked on the sheet stacking portion, a lifting and lowering device that includes a driving source and performs lifting and lowering operations of the sheet stacking portion by driving the driving source, a controller that controls the driving source, a locking portion, provided in the cassette body, that can move to a locked position in which the sheet stacking portion is locked in the cassette body and an unlocked position in which the sheet stacking portion is unlocked, a holding portion that holds the locking portion in the unlocked position, and an actuation portion that moves the locking portion from the locked position to the unlocked position by a driving force of the driving source in order that the locking portion is held by the holding portion in advance of the lifting operation of the sheet stacking portion.

Further features of the present invention will become apparent from the following description of exemplary embodiments with reference to the attached drawings.

DESCRIPTION OF THE EMBODIMENTS

Figure 1:
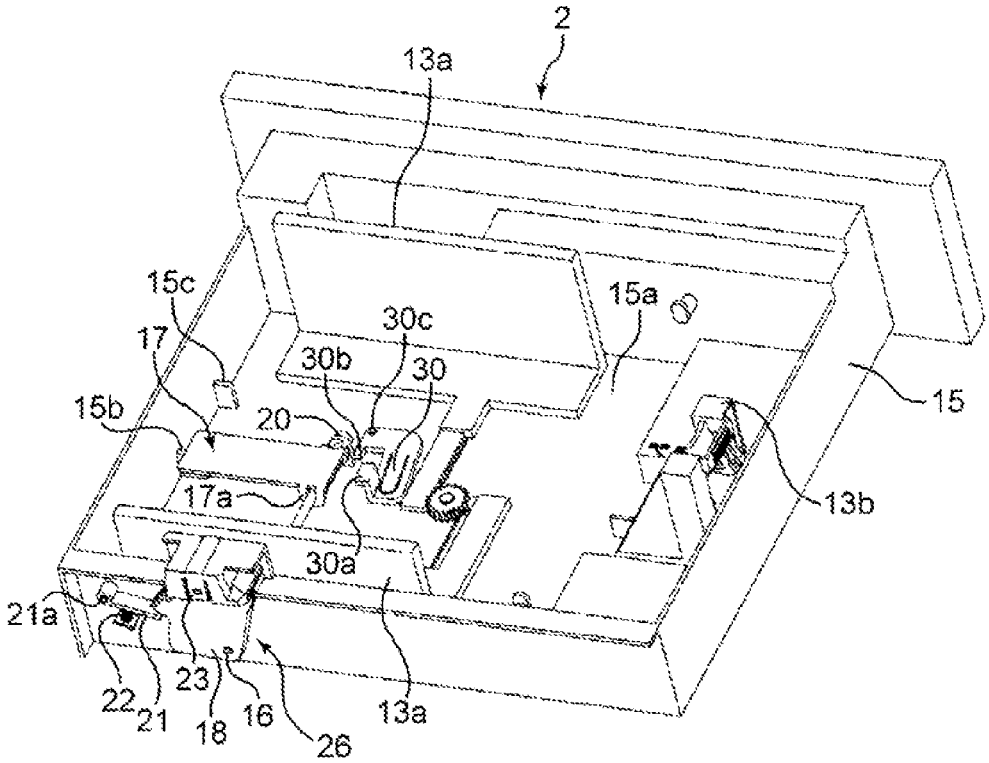
FIG. 1 is a perspective view illustrating a lifting and lowering device according to a first embodiment of the invention.

Hereinafter, exemplary embodiments of the invention will be described in detail with reference to the drawings. However, it is to be noted that a size, a material, a shape, a relative disposition, and the like of a component described in the following embodiment are properly changed by a configuration and various conditions of an apparatus to which the invention applied. Accordingly, the invention is not limited to the size, the material, the shape, the relative disposition, and the like of the component unless otherwise noted.

First Embodiment

A sheet feeding apparatus according to a first embodiment of the invention and an image forming apparatus provided therewith will be described with reference to FIGS. 1 to 7. A first embodiment in which the invention is applied to a sheet cassette 2 mounted in an image forming apparatus will be described below. A schematic configuration of a Laser Beam Printer 1 (hereinafter referred to as an LBP 1) that is of the image forming apparatus will be described with reference to FIG. 7 which is a main sectional view thereof.

The LBP 1 includes an apparatus body 1*a*. The apparatus body 1*a* includes a controller 25 that controls each portion as a whole, a sheet cassette 2 in which sheets S are stored while stacked, and a pickup roller 3 that is of the sheet feeding portion to deliver the sheet S stacked on the sheet cassette 2 from the uppermost side. The apparatus body 1*a* includes a pair of retard rollers 4 (4*a* and 4*b*) that conveys the delivered sheet S while separating one by one.

The apparatus body 1*a* includes a process cartridge 7 in which a well-known process of forming the image is incorporated, and the process cartridge 7 is detachably attached to the apparatus body 1*a*. A photosensitive drum 7*a* that is of the image bearing member is disposed in the process cartridge 7, and a laser exposure device 8 exposes the photosensitive drum 7*a* with a laser beam to write image information on the photosensitive drum 7*a*. A transfer roller 9 is pressed against the photosensitive drum 7*a*, and a toner image on a surface of the photosensitive drum 7*a* is transferred to the sheet S passing between the photosensitive drum 7*a* and the transfer roller 9. The process cartridge 7 including the photosensitive drum 7*a* and the transfer roller 9 constitutes an image forming portion that forms the image in the sheet S fed from a stacking plate (sheet stacking portion) 14.

A fixing device 10 is disposed on a downstream side of the image forming portion, and fixes the transferred image by applying heat and a pressure to the sheet S after the image is transferred. The sheet S is conveyed after the image is fixed, and a pair of discharge rollers 11 discharges the sheet S to a discharge tray 12, which is formed in an upper surface of the apparatus, while an image surface is oriented downward.

Configurations and functions of the sheet cassette 2 and a lifting and lowering device 26 will be described below with reference to FIGS. 1 and 2. The stacking plate 14 is omitted in FIG. 1.

Figure 2:
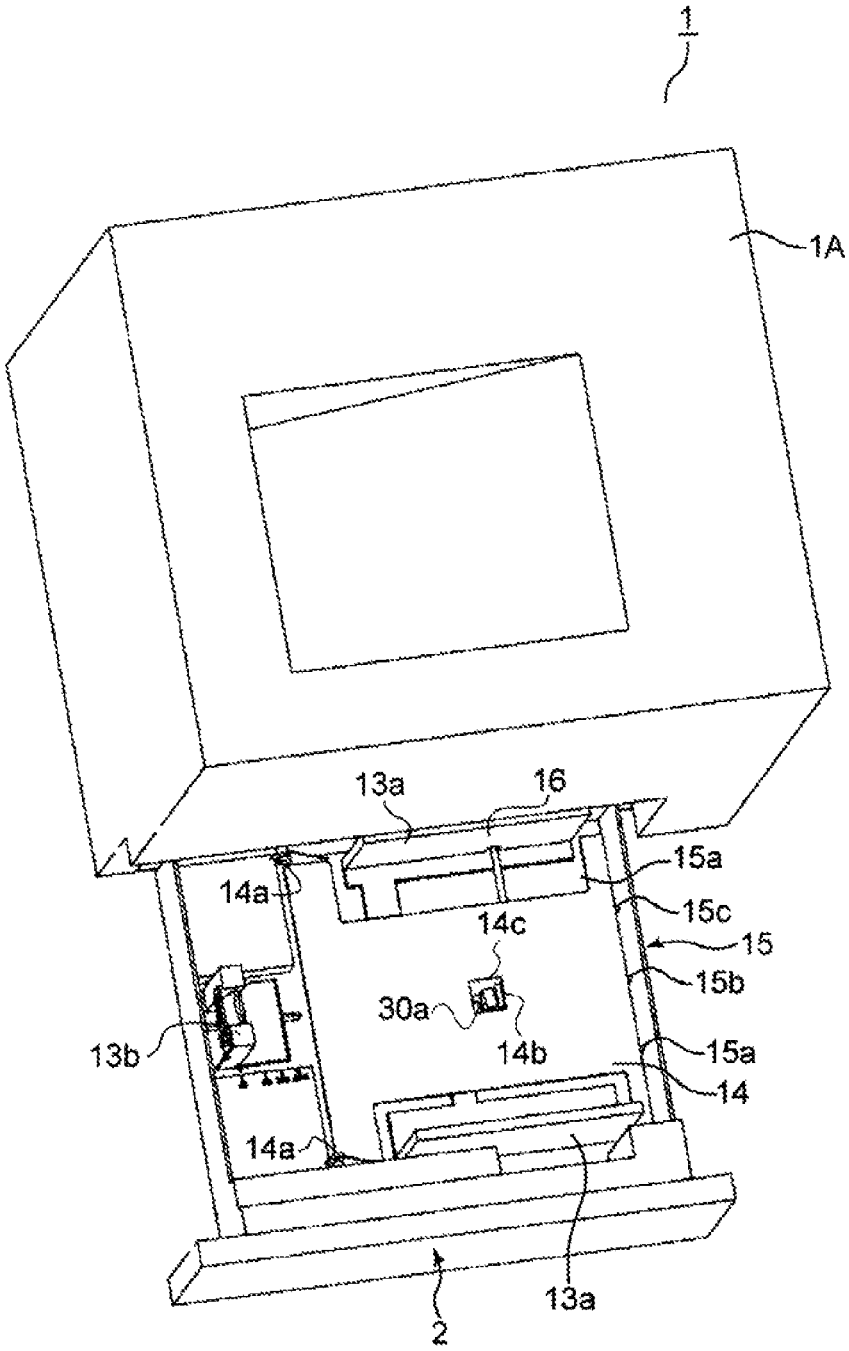
FIG. 2 is a perspective view illustrating an image forming apparatus and a sheet cassette of the first embodiment.

As illustrated in FIGS. 1 and 2, the sheet cassette 2 is adapted to be able to be drawn from an apparatus body 1*a* of the LBP 1. Regulating members 13*a* and 13*a* that regulate side end parts of the sheet stacked on the sheet cassette 2 and a regulating member 13*b* that regulates a rear end part of the sheet are provided in the sheet cassette 2 while being able to slide relative to a cassette body 15 that is detachably attached to the apparatus body 1*a*.

The stacking plate (sheet stacking portion) 14 is disposed on a bottom 15*a* of the sheet cassette 2 while being turnable with a turning support 14*a* as a supporting point. The stacking plate 14 constitutes the sheet stacking portion that can perform a lifting and lowering operation. A bottom of the stacking plate 14 is supported by a rib 15*c* provided in a bottom surface of the cassette body 15 while the sheet cassette 2 is drawn, thereby regulating the turning in a lowering direction.

A lifter shaft 16 is retained below the stacking plate 14 while being rotatable relative to the cassette body 15, and the lifter shaft 16 is a turning shaft that turns by receiving a driving force from a lift motor 44 (see FIG. 4A) that is of the driving source. A sector gear 18 is fixed to one end part of the lifter shaft 16, and a stacking plate pushing-up plate (pushing-up member) 17 is supported in the other end part of the lifter shaft 16 while being turnable relative to the lifter shaft 16. In the stacking plate pushing-up plate 17, a plate-like leading end extends toward the rib 15*b*, and a rear end is turnably supported by the lifter shaft 16 through brackets 17*a* and 17*a*, which are bent downward at both ends of the rear end. In the stacking plate pushing-up plate 17, the turning in the lowering direction is regulated by a rib 15*b* of the bottom 15*a* of the cassette body 15 while the sheet cassette 2 is drawn from the apparatus body 1*a*.

An end part (one end part) on a deep side in a cassette inserting direction of the lifter shaft 16 is projected to the outside of the cassette body 15, and the sector gear 18 is fixed to the end part of the projected lifter shaft 16. On the other end part of the lifter shaft 16, a turning arm 20 that constitutes an actuation portion of the invention is fixed with orienting substantially downward. In the lifter shaft 16, an abutment member 19 (see FIG. 3) is fixed to a region corresponding to the stacking plate pushing-up plate 17, and the abutment member 19 can be brought into contact with and separated from a rear surface of the stacking plate pushing-up plate 17. Therefore, the turning arm 20 and the abutment member 19 are adapted to be integrally turnably with the lifter shaft 16.

The sector gear 18 is retained while an outer circumferential end part of the sector gear 18 abuts on and engage with a sector gear stopper 21 disposed in a side part of the cassette body 15. In the sector gear stopper 21, a boss 21*a* (see FIG. 1) is projected from a side surface of the cassette body 15. The sector gear stopper 21 is biased upward by a biasing force of a compression spring 22 disposed below while supported by the boss 21*a* being a turning center.

A pinion 23 (see FIG. 4A) is provided in the apparatus body 1*a* in a position, in which the sheet cassette 2 engages with the sector gear 18 while being mounted on the apparatus body 1*a*. When the sheet cassette 2 is inserted in the apparatus body 1*a*, the pinion 23 engages the sector gear 18 and is rotated by the lift motor 44 provided in the apparatus body 1*a*. When the sector gear 18 rotates in response to the rotation of the pinion 23, the stacking plate 14 turns with the turning support 14*a* as the supporting point through the abutment member 19 and the stacking plate pushing-up plate 17, thereby lifting and lowering the sheet S.

The lift motor 44 is driven under the control of a controller 25 (see FIG. 7) provided in the apparatus body 1*a*. The controller 25 drives the lift motor 44 to rotate the pinion 23 based on a detection signal from a paper plane sensor (not illustrated) that detects the upper surface of the sheet. The controller 25 controls the stacking plate 14 through the sector gear 18, the lifter shaft 16, and the stacking plate pushing-up plate 17 so as to lift the stacking plate 14.

The controller 25 controls the stacking plate 14 so as to lift the stacking plate 14 to a position in which a proper pressure is applied within a substantially constant range between the upper surface of the sheet supported in feeding and the pickup roller 3. When the sheet cassette 2 is drawn from the apparatus body 1*a*, the engagement between the pinion 23 and the sector gear 18 is released to lower the stacking plate 14 to the bottom 15*a* of the sheet cassette 2.

Figure 4A:
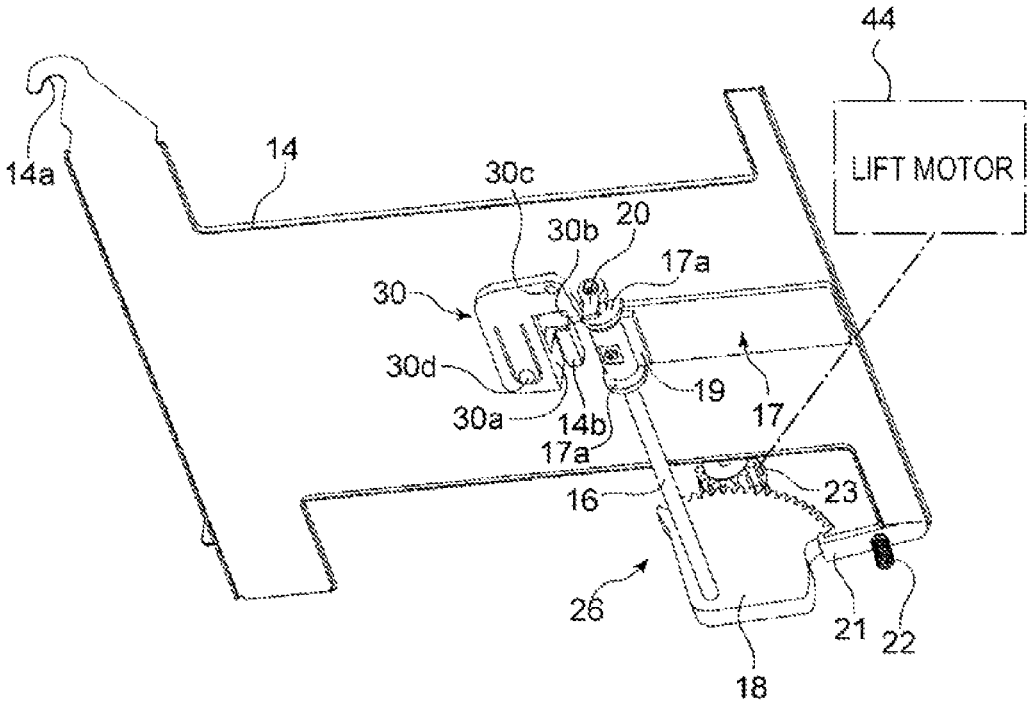
FIG. 4A is a perspective view illustrating a stacking plate lock portion of the first embodiment.
Figure 4B:
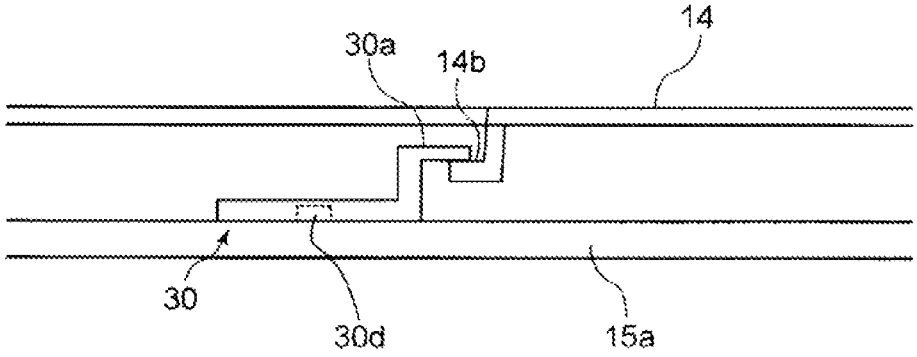
FIG. 4B is a sectional view illustrating the stacking plate lock portion.
Figure 5:
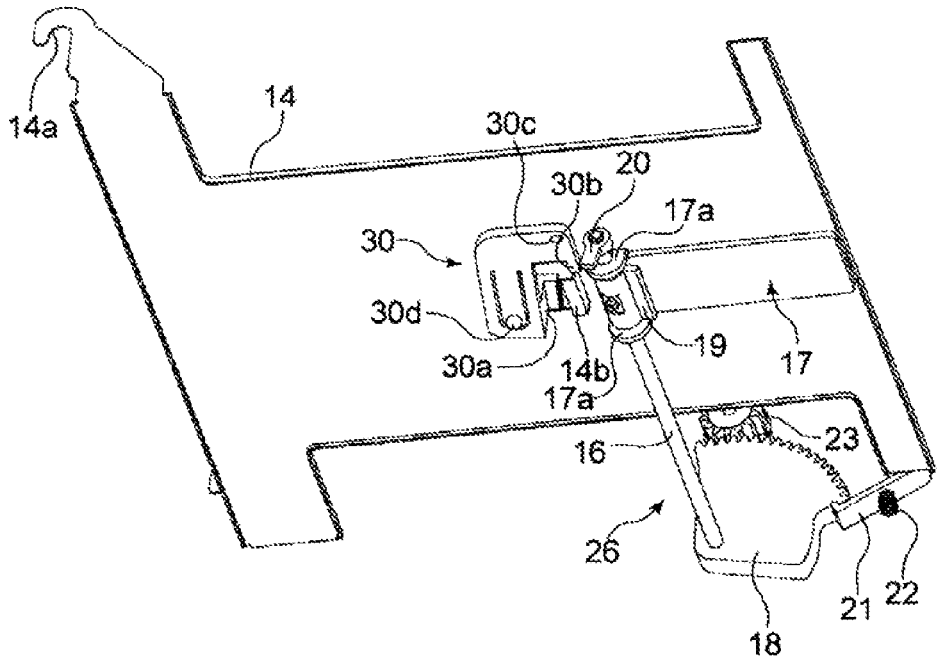
FIG. 5 is a perspective view illustrating the stacking plate lock portion of the first embodiment.
Figure 6:
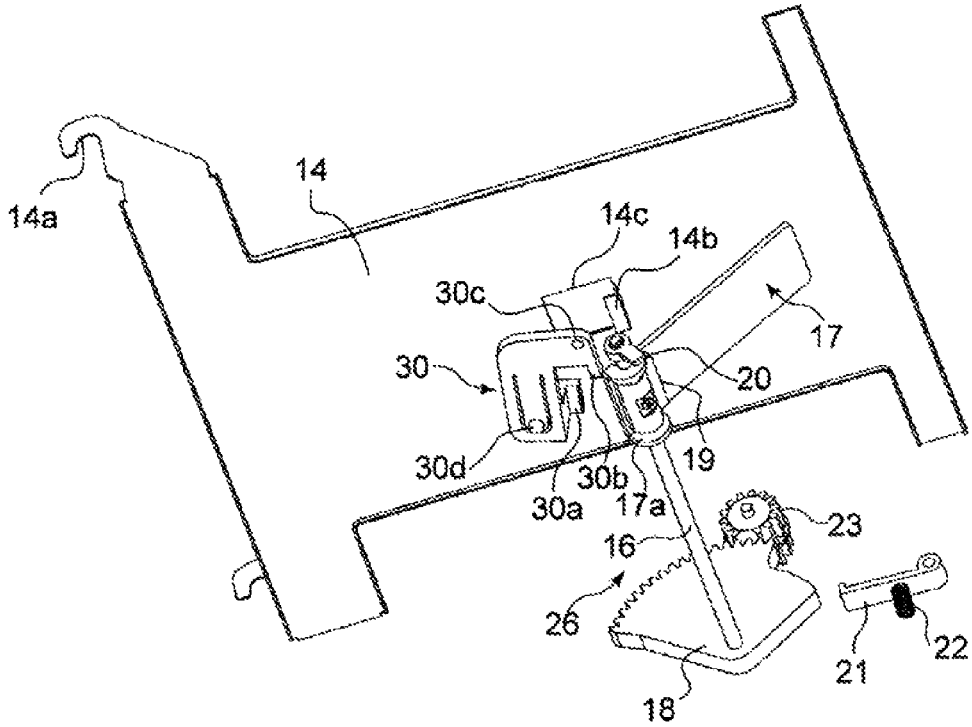
FIG. 6 is a perspective view illustrating the stacking plate lock portion of the first embodiment.

A configuration of a stacking plate lock portion of the embodiment will be described with reference to FIGS. 4, 5, and 6. FIGS. 4 to 6 are perspective views illustrating the lifting and lowering device 26 (see FIG. 1) when viewed from below the stacking plate 14. FIG. 4A illustrates a state in which a lock lever 30 is located in a locked position, and FIG. 5 illustrates the lifting and lowering device in a state in which the lock lever 30 turns to an unlocked position by the turning arm 20. FIG. 6 illustrates a state in which the stacking plate 14 is lifted to the feeding position by the lifting and lowering device.

As illustrated in FIGS. 4 to 6, the lock lever 30 is provided in the sheet cassette 2 in order that the stacking plate 14 is pressed so as not to move in transporting the apparatus. The lock lever 30 is supported by a bottom 15*a* of the cassette body 15 while being turnable about a boss 30*c* (also see FIG. 1) provided in the bottom 15*a*. The lock lever 30 is formed into a substantial L-shape as a whole. In the lock lever 30, a hook-shaped lock projection 30*a* is integrally formed in an end part distant from the boss 30*c*, and an abutment portion 30*b* which is bent into a needle shape so as to face the turning arm 20 fixed to the lifter shaft 16 is integrally formed in an end part close to the boss 30*c*.

The lock lever 30 is attached to the bottom 15*a* of the cassette body 15 while being turnable between the locked position and the unlocked position. As illustrated in the sectional view of FIG. 4B, in the locked position, the lock projection 30*a* is engaged with the engagement portion 14*b* of the stacking plate 14 according to a lower position to lock the stacking plate 14 with respect to the cassette body 15. In the unlocked position, the lock projection 30*a* is separated from the engagement portion 14*b* to release the lock in lifting the stacking plate 14. The lock lever 30 is adapted to be able to be retained in the locked position or the unlocked position such that an integrally-formed latch projection 30*d* is engaged with an engagement hole (not illustrated) made in the bottom 15*a* of the cassette body 15 in a snap-fit manner. The latch projection 30*d* is provided in the lower surface of the lock lever 30, and the latch projection 30*d* can elastically be deformed in a vertical direction by a notch of the lock lever 30. Therefore, the latch projection 30*d* can engage and disengage the engagement hole (not illustrated) made in the bottom 15*a* of the cassette body 15. The latch projection 30*d* and the engagement hole that engages the latch projection 30*d* when the lock lever 30 moves to the unlocked position constitute the holding portion of the invention.

In the first embodiment, the lift motor 44 that is of the driving source, the pinion 23, the sector gear 18, the lifter shaft (turning shaft) 16, the stacking plate pushing-up plate (pushing-up member) 17, and the abutment member 19 constitute the lifting and lowering device 26 that performs the lifting and lowering operation of the stacking plate 14. The lift motor 44 and the turning arm 20 constitute the actuation portion of the invention. The lifter shaft 16 turns by receiving the driving force from the lift motor 44, and the turning arm 20 is fixed to the lifter shaft 16 so as to turn along with the lifter shaft 16. The stacking plate pushing-up plate 17 is turnably supported in a position facing the abutment member 19 in the lifter shaft 16, and the stacking plate pushing-up plate 17 pushes up the stacking plate 14 from the lower position while abutting on the abutment member 19. The abutment member 19 is fixed to the lifter shaft 16 so as to turn integrally with the lifter shaft 16. The lifting and lowering device 26 is adapted such that the lock lever 30 turns to the unlocked position in advance of the lifting operation of the stacking plate 14 when the stacking plate 14 that is locked in the lower position by the lock lever 30 is lifted while the sheet cassette 2 is loaded on the apparatus body 1*a*.

The turning arm 20 is fixed to the lifter shaft 16 so as to turn along with the lifter shaft (turning shaft) 16. The abutment member 19 is also fixed to the lifter shaft 16 so as to turn integrally with the lifter shaft 16. The stacking plate pushing-up plate 17 is turnably supported in the position facing the abutment member 19 in the lifter shaft 16, and the stacking plate pushing-up plate 17 pushes up the stacking plate 14 from the lower position while abutting on the abutment member 19 from the rear surface. Before a first-direction turning operation to lift the stacking plate 14 through the stacking plate pushing-up plate 17, the lifter shaft 16 turns in a second direction opposite to a first direction once to move the stacking plate 14 to the unlocked position in which the lock projection 30*a* is separated from the engagement portion 14*b* through the turning arm 20. Then the lifter shaft 16 turns in the first direction to enable the stacking plate 14 to be lifted through the abutment member 19 and the stacking plate pushing-up plate 17.

Figure 3A:
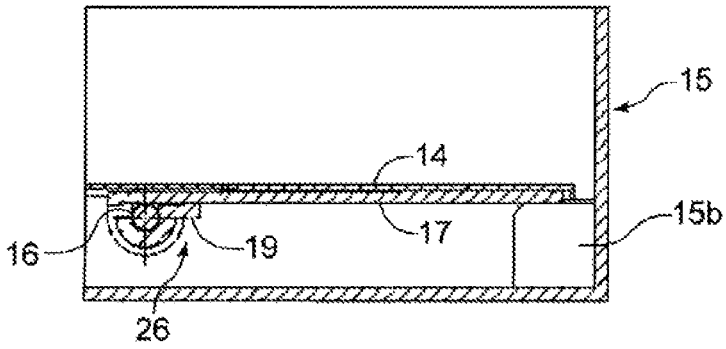
FIGS. 3A, 3B, and 3C are sectional views illustrating the lifting and lowering device of the first embodiment.
Figure 3B:
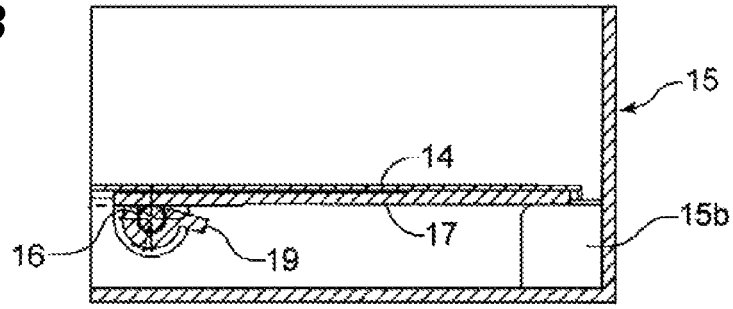
Figure 3C:
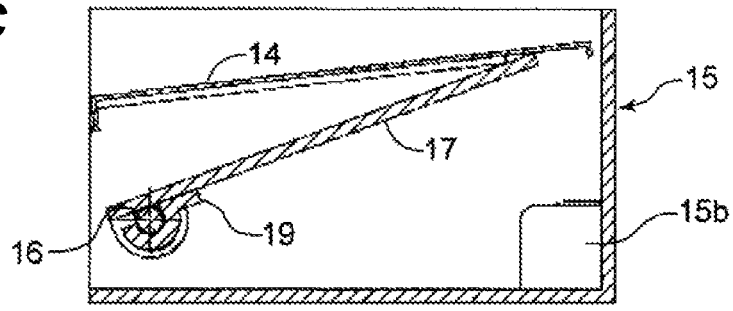

A relationship among the lifter shaft 16, the abutment member 19, and the stacking plate pushing-up plate 17 will be described in detail with reference to FIG. 3. FIG. 3A illustrates the lifting and lowering device 26 in a state in which the stacking plate 14 is located in the lowered position, and FIG. 3B illustrates a state in which the sector gear 18 turns clockwise against a spring force of the compression spring 22 that biases the sector gear stopper 21 upward. FIG. 3C illustrates a state in which the stacking plate 14 is being lifted by the lifting and lowering device 26.

As illustrated in FIG. 3A, one end of the stacking plate pushing-up plate 17 is supported by the rib 15*b* provided in the cassette body 15, and the lifter shaft 16 and the abutment member 19 stop while the sector gear 18 abuts on the sector gear stopper 21.

As illustrated in FIG. 3B, although the stacking plate pushing-up plate 17 remains supported by the rib 15*b* of the cassette body 15, the lifter shaft 16 and the abutment member 19 turn clockwise to separate the abutment member 19 from the stacking plate pushing-up plate 17. At this point, the lock lever 30 is turned in the unlocked direction by the turning arm 20 to separate the lock projection 30*a* from the engagement portion 14*b*, thereby entering the state in which the stacking plate 14 can be lifted.

As illustrated in FIG. 3C, in association with counterclockwise turning of the sector gear 18, the lifter shaft 16 and the abutment member 19 turns in the same direction as the sector gear 18, and the abutment member 19 abuts on the stacking plate pushing-up plate 17 from the rear surface, whereby stacking plate pushing-up plate 17 turns counterclockwise along with the stacking plate 14.

On the other hand, as illustrated in FIG. 2, an opening 14*c* is formed in a substantially central part of the stacking plate 14 while piercing through the stacking plate 14, and an engagement portion 14*b* is formed in a region that can face the lock projection 30*a* in an inner periphery of the opening 14*c*.

An operation in pressing the stacking plate 14 will be described below. In a case when it is necessary to fix the stacking plate 14 before the shipping of the LBP 1 or during the movement of the LBP 1, while the sheet cassette 2 is drawn from the apparatus body 1*a* once, a finger or a tool is taken in from the opening 14*c* of the stacking plate 14 to perform an operation to turn the lock lever 30. The lock lever 30 is turned to the position illustrated in FIG. 4A, and the lock projection 30*a* is locked by engaging the lock projection 30*a* with the engagement portion 14*b*, which allows the upward movement of the stacking plate 14 to be securely regulated.

When the sheet cassette 2 is inserted while the apparatus body 1*a* is not powered on, the stacking plate 14 is maintained in the locked state, so that the casual movement of the stacking plate 14 can be prevented during the shipment or move of the apparatus body 1*a*.

When a detection portion (not illustrated) detects that the sheet cassette 2 is mounted on the apparatus body in turning on the power of the LBP 1 for use, the controller 25 turns (reversely turns) the lift motor 44 by a predetermined amount in an opposite direction to the direction in which the stacking plate 14 is lifted.

When the lift motor 44 is reversely rotates to rotate the pinion 23 in the counterclockwise direction in FIG. 4, the sector gear 18 rotates clockwise against the compression spring 22 that bears the sector gear stopper 21 from below. Because the turning arm 20 abuts on the abutment portion 30*b* of the lock lever 30 by the turning of the turning arm 20 fixed to the other end of the lifter shaft 16, the lock lever 30 turns from the locked position to the unlocked position in association with the turning of the turning arm 20.

A rotation amount in the reverse direction of the lift motor 44 is set to an amount necessary to turn the lock lever 30 in the locked position to the unlocked position (see FIG. 5). After the predetermined rotation is ended, the controller 25 switches the rotation direction of the lift motor 44 to drive the lift motor 44 in the direction in which the stacking plate 14 is lifted.

Then, through the above lifting control, the lifting and lowering device 26 controls the stacking plate 14 at a substantially constant level at which a proper pressure is applied between the upper surface of the sheet and the pickup roller 3.

FIG. 6 illustrates a state in which the lifting and lowering device lifts the stacking plate 14 to the feeding position. The motor control in which the lift motor 44 is reversely rotated in initial lifting may be performed only immediately after the apparatus body 1*a* is powered on.

Even if the reverse rotation control is always performed in detecting the insertion of the sheet cassette 2 in the apparatus body 1*a* in order to simplify the control of the lift motor 44, the lock lever 30 or the lifting and lowering device 26 is not broken.

As described above, according to the first embodiment, the unlocking can be performed using the configuration including the existing lifting and lowering device without providing the dedicated mechanism that automatically unlocks the stacking plate 14 with the lock lever 30. The user can easily reuse the member used in the locking while the motor having excessive performance is not used as the lift motor 44 that lifts and lowers the stacking plate 14. Thus, the generation of the trouble such as the breakage of the apparatus, which is attributed to the fact that the user forgets to unlock the stacking plate 14, can be avoided by the simple configuration in which the existing configuration can be used, and the lock structure of the stacking plate 14 can be made so as to be reused in the movement of the apparatus such as the move.

Second Embodiment

Configurations and functions of a sheet feeding apparatus according to a second embodiment of the invention and a stacking plate lock portion in an image forming apparatus provided with the sheet feeding apparatus will be described with reference to FIGS. 8 and 9. The second embodiment differs from the first embodiment in that the configuration of the lock lever 30 is changed. Therefore, in the initial lifting for unlocking the stacking plate (sheet stacking portion) 14, it is not necessary to reversely rotate the lift motor 44 (see FIG. 4). In the second embodiment, the same component as the first embodiment is denoted by the same numeral, and the descriptions of the same configuration and function are omitted.

Figure 8:
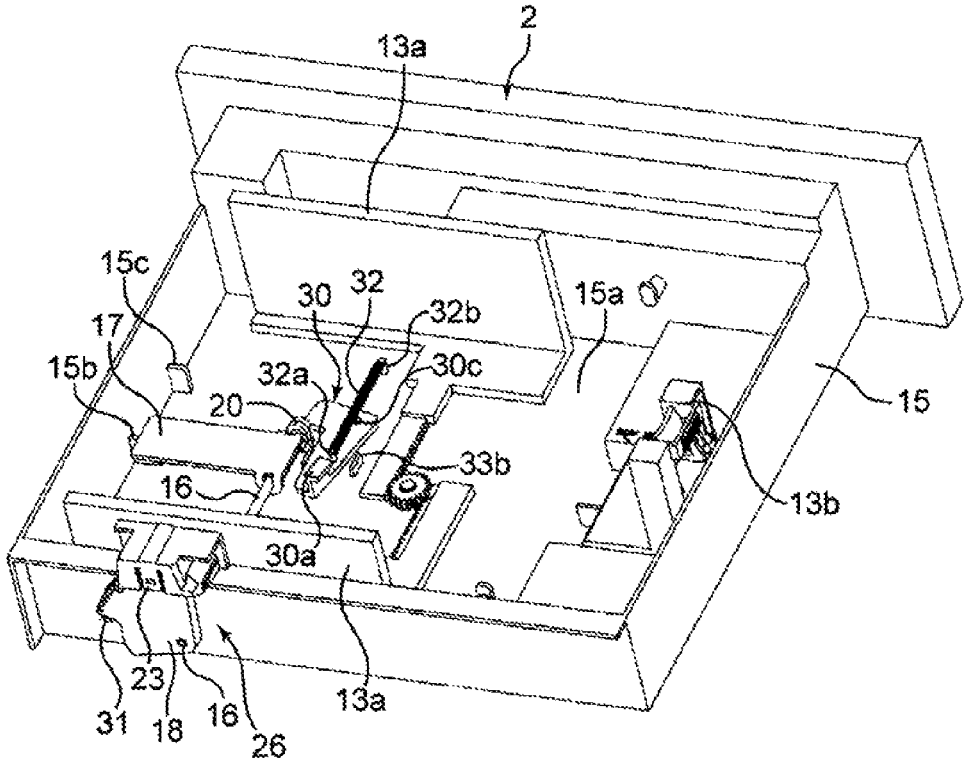
FIG. 8 is a perspective view illustrating a lifting and lowering device according to a second embodiment of the invention.

As illustrated in FIGS. 8 and 9, in the sheet cassette 2 drawn from the apparatus body 1*a*, the sector gear 18 abuts on a stopper 31 that is integrally formed in a side part of the cassette body. Therefore, the lifter shaft 16 and the turning arm 20 are retained in a position in which the abutment member 19 is separated from the stacking plate pushing-up member 17. The lock lever 30 constituting the stacking plate lock portion of the second embodiment turns in the opposite direction to the lock lever 30 of the first embodiment to engage the lock projection 30*a* with the engagement portion 14*b* (see FIG. 2). The lock lever 30 of the second embodiment turns in the opposite direction to become the unlocked position in which the lock projection 30*a* is separated from the engagement portion 14*b*.

A toggle spring 32 that is of a tension spring is stretched between a boss 32*a* projected from the lock lever 30 and a boss 32*b* provided in the cassette body 15. Usually the lock lever 30 is struck on and retained by the stopper 33*a* provided in the bottom 15*a* of the cassette body 15 while rotationally biased in the unlocked position. At this point, the abutment portion 30*b* of the lock lever 30 retracts to a position in which the abutment portion 30*b* does not interfere with a turning locus of the turning arm 20 fixed to the end part of the lifter shaft (turning shaft) 16, and the position of the abutment portion 30*b* is set so as not to affect the lifting operation of the stacking plate 14 by the lifting and lowering device 26. A stopper 33*b* is projected in the position facing the stopper 33*a* on the bottom 15*a* while being predetermined distant away from the stopper 33*a*.

Similarly to the first embodiment, the lock lever 30 is turned to the locked position while the sheet cassette 2 is drawn, namely, while the stacking plate 14 is located at the lowermost position, thereby fixing the stacking plate (sheet stacking portion) 14 of the second embodiment. In the second embodiment, the lift motor 44 (FIG. 4), the pinion 23 (FIG. 8), the sector gear 18, the lifter shaft 16, the stacking plate pushing-up plate 17, and the abutment member 19 fixed to the lifter shaft 16 constitute the lifting and lowering device 26 that performs the lifting and lowering operation of the stacking plate 14. The lift motor 44 and the turning arm 20 constitute the actuation portion of the invention. The lifter shaft 16 turns by receiving the driving force from the lift motor 44 that is of the driving force, and the turning arm 20 is fixed to the lifter shaft 16 so as to turn along with the lifter shaft 16. The stacking plate pushing-up plate (pushing-up member) 17 is turnably supported in the position facing the abutment member 19 in the lifter shaft 16, and the stacking plate pushing-up plate 17 pushes up the stacking plate 14 from the lower position while abutting on the abutment member 19. The abutment member 19 is fixed to the lifter shaft 16 so as to turn integrally with the lifter shaft 16.

Figure 9A:
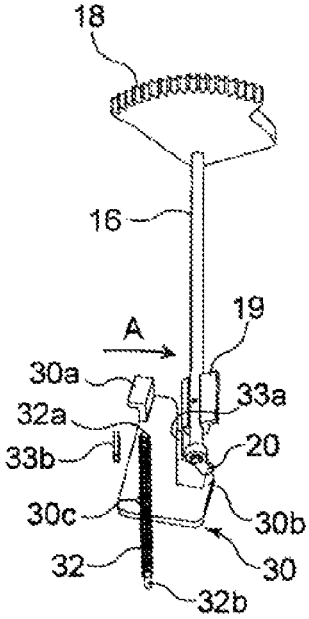
FIGS. 9A, 9B, and 9C are perspective views illustrating an operation of the stacking plate lock portion of the second embodiment.

An operation of the lock lever 30 biased by the toggle spring 32 will be described with reference to FIG. 9. FIG. 9A illustrates a state in which the lock lever 30 is located in the unlocked position, FIG. 9C illustrates a state in which the lock lever 30 is located in the locked position, and FIG. 9B illustrates a state in which the lock lever 30 is located at a neutral point of the toggle spring 32.

As described above, in the normal operation of the LBP 1, the lock lever 30 is located in the unlocked position illustrated in FIG. 9A. At this point, the toggle spring 32 is deviated onto the right in FIG. 9 from the boss 30*c* that is of the rotation center of the lock lever 30. Therefore, the biasing force of the toggle spring 32 acts on the lock lever 30 so as to turn the lock lever 30 in a direction of an arrow A of FIG. 9A, whereby the lock lever 30 is retained while abutting on the stopper 33*a* on the right of FIG. 9. As illustrated in FIG. 9C, in the locked state, a gap SP is provided between the abutment member 19 and the stacking plate pushing-up plate 17 in order to generate a time difference such that the turning force of the abutment member 19 is transmitted to the stacking plate pushing-up plate 17 after the stacking plate 14 is unlocked.

Figure 9B:
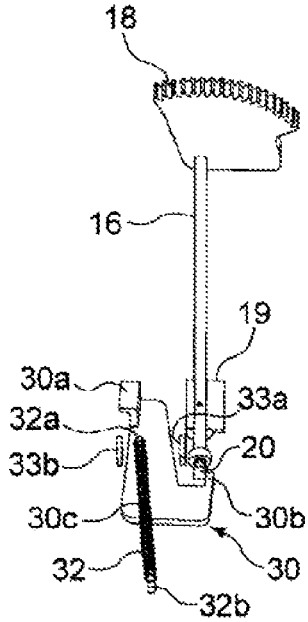
Figure 9C:
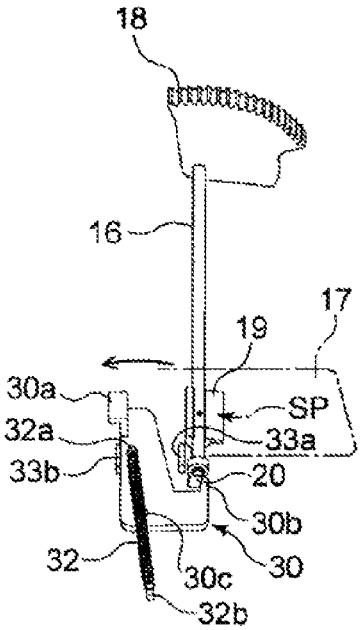

On the other hand, in a case when the lock lever 30 is turned onto the left of FIG. 9 in order to fix the stacking plate 14, the biasing force of the toggle spring 32 is inverted when the toggle spring 32 passes through the neutral point of FIG. 9B, and the biasing force rotates the lock lever 30 in the direction of the locked position. As a result, the lock lever 30 abuts on the right stopper 33*b* as illustrated in FIG. 9C, and is retained in the locked position. When the lock lever 30 is located in the locked position, the position of the abutment portion 30*b* of the lock lever 30 is adjusted such that the abutment portion 30*b* abuts substantially on the turning arm 20 fixed to the end part of the lifter shaft 16.

When the controller 25 (see FIG. 7) detects the insertion of the sheet cassette 2 after the main body of the LBP 1 is powered on, the controller 25 rotates the lift motor 44 in the direction in which the stacking plate 14 is lifted. The sector gear 18 and the turning arm 20 fixed to the end part of the lifter shaft also rotate in association with the rotation of the pinion 23. However, at this point, the abutment portion 30*b* of the lock lever 30 abuts on the turning arm 20. Therefore, the lock lever 30 is rotated in the direction (clockwise direction of FIG. 9 about the boss 30*c*) of the unlocked position against the biasing force of the toggle spring 32.

When the lock lever 30 rotates, the toggle spring 32 that rotationally biases the lock lever 30 also moves. When the lock lever 30 rotates not lower than a given amount (given angle), the toggle spring 32 passes on the boss 30*c* that is of the rotation center of the lock lever 30, thereby inverting the biasing force of the toggle spring 32. Therefore, the lock lever 30 is biased in the direction (clockwise direction of FIG. 9 about the boss 30*c*) of the unlocked position, and the lock lever 30 is retained while abutting on the stopper 33*a*. The toggle spring 32 constitutes the holding portion of the invention.

The relationship between the toggle spring 32 and the boss 30*c* that is of the rotation center of the lock lever 30 is set such that the biasing force of the toggle spring 32 is inverted before the abutment member 19 fixed to the center of the lifter shaft 16 reaches the position in which the abutment member 19 abuts on the stacking plate pushing-up plate 17. Accordingly, the following operation is performed before the abutment member 19 abuts on the stacking plate pushing-up plate 17 to lift the stacking plate 14 through the stacking plate pushing-up plate 17 using the driving force of the lift motor 44. That is, the toggle spring 32 provides the bias to turn the lock lever 30, and the abutment portion 30*b* of the lock lever 30 is separated from the turning arm 20 in the end part of the lifter shaft and retained in the unlocked position.

In the second embodiment, when the lock lever 30 is located in the unlocked position, the turning arm 20 and the lock lever 30 do not interfere with each other. On the other hand, when the lock lever 30 is located in the locked position, the lock lever 30 is securely turned by the lifting operation of the unidirectional rotation of the lift motor 44, and the stacking plate 14 can be unlocked. In the second embodiment, the a toggle mechanism including the toggle spring 32 and the stoppers 33*a* and 33*b* is also provided in order to retain the lock lever 30, in which the lock projection 30*a* is separated from the engagement portion 14*b*, in the unlocked position. Therefore, the generation of the trouble such that the lock lever 30 located in the unlocked position returns casually to the locked position can securely be prevented.

In the second embodiment, the lifting and lowering device 26 includes the lifter shaft 16 that turns by receiving the driving force from the lift motor 44, the turning arm 20 and the abutment member 19, which are fixed to the lifter shaft 16 so as to turn along with the lift shaft 16, and the stacking plate pushing-up plate 17. The stacking plate pushing-up plate 17 is turnably supported in the position facing the abutment member 19 in the lifter shaft 16, and the stacking plate pushing-up plate 17 pushes up the stacking plate 14 from the lower position while abutting on the abutment member 19. The lifter shaft 16 separates the lock projection 30*a* from the engagement portion 14*b* through the turning arm 20 by a sequence of unidirectional turning operations to lift the stacking plate 14 through the stacking plate pushing-up plate 17. Then the lifter shaft 16 lifts the stacking plate 14 through the abutment member 19 and the stacking plate pushing-up plate 17. The same effect as the first embodiment can be obtained in the second embodiment.

In the second embodiment, because the stacking plate 14 can securely be unlocked without reversely driving the lift motor 44, the controller 25 can more simply control the lift motor 44.

Third Embodiment

Configurations and functions of a sheet feeding apparatus according to a third embodiment of the invention and an image forming apparatus provided with the sheet feeding apparatus will be described with reference to FIGS. 10 to 14. In the third embodiment, the invention is applied to the LPB 1 that is of the image forming apparatus provided with a large-capacity deck 50 including the large-capacity sheet cassette 2 connected to the apparatus body 1*a*. In the third embodiment, the same component as the first and second embodiments is denoted by the same numeral, and the descriptions of the same configuration and function are omitted.

Figure 10:
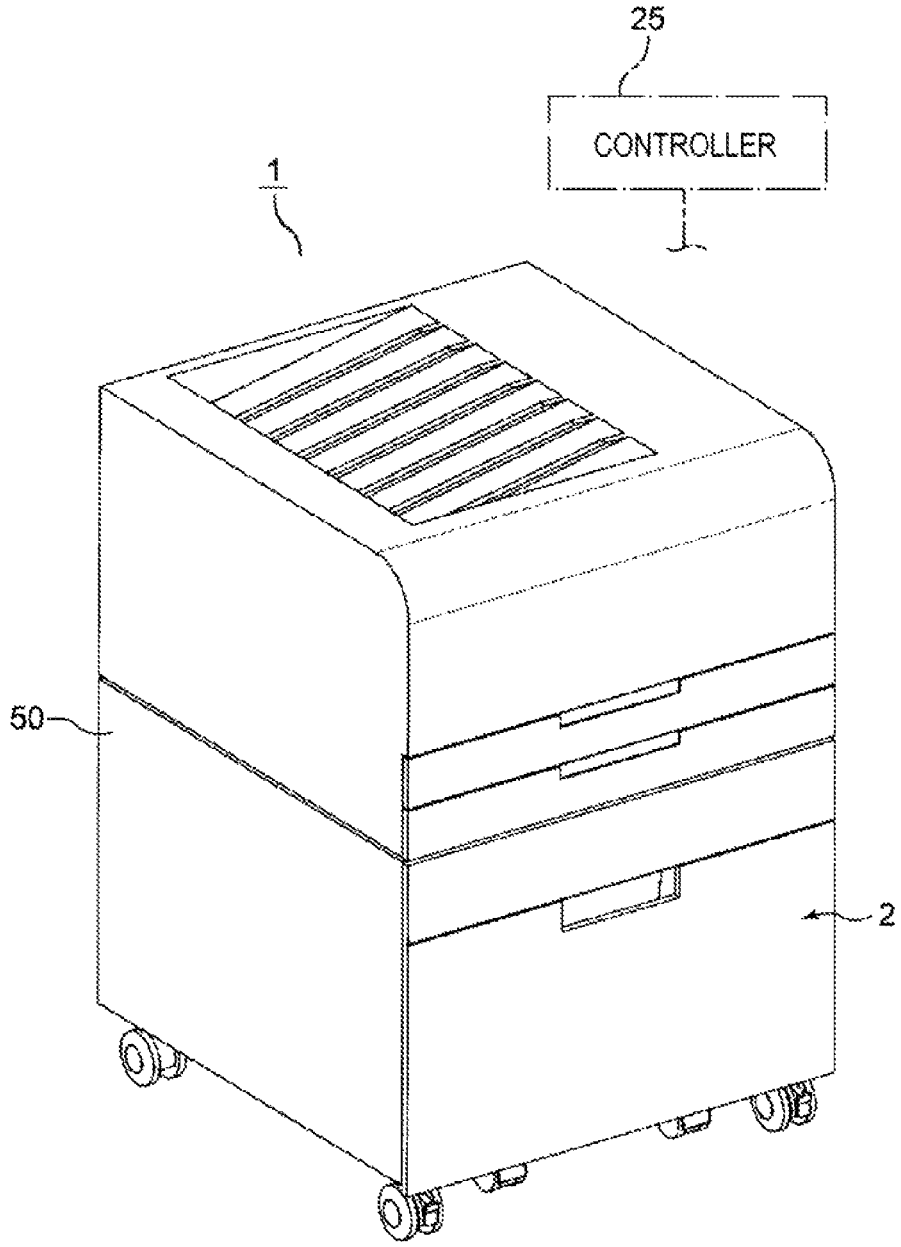
FIG. 10 is a perspective view illustrating an image forming apparatus and a large-capacity deck according to a third embodiment of the invention.

As illustrated in FIG. 10, the large-capacity deck 50 (hereinafter referred to as a deck) including the sheet feeding apparatus of the third embodiment is connected to the lower part of the apparatus body 1*a* to function also as a placement board of the LBP 1. Similarly to the first and second embodiments, the LBP 1 of the third embodiment includes the controller 25 that wholly controls each portion.

Figure 11:
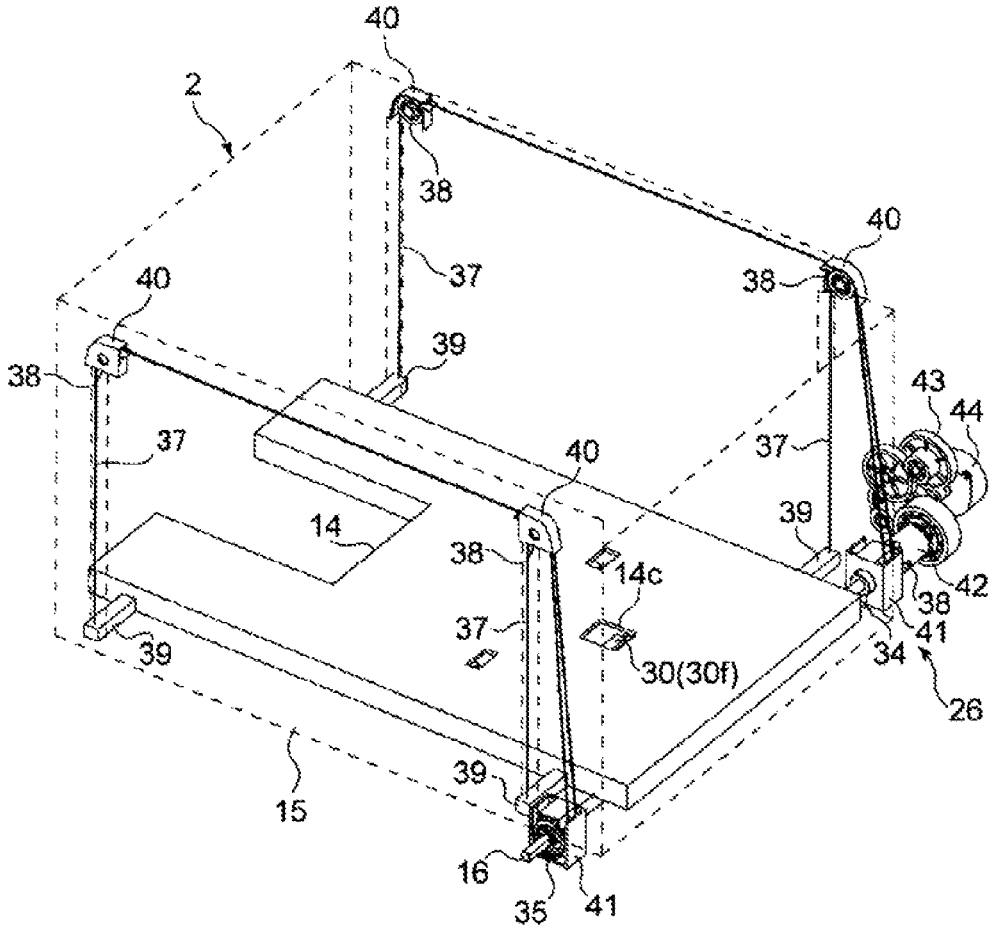
FIG. 11 is a perspective view illustrating a lifting and lowering device of the third embodiment.

The lifting and lowering device 26 used in the deck 50 will be described with reference to FIG. 11. FIG. 11 is a perspective view schematically illustrating the sheet cassette 2 of the deck 50 and the lifting and lowering device 26.

The lifter shaft (turning shaft) 16 disposed in the lower part of the stacking plate 14 turns by receiving the driving force from the lift motor 44, and the lifter shaft 16 is turnably retained through a bearing 34 fixed to the cassette body 15 illustrated by a broken line of FIG. 11. Two winding drums (winding mechanisms) 35 are fixed to each of the end parts of the lifter shaft 16 (the two winding drums 35 on the deep side are not illustrated in FIG. 11). A parallel pin 36 is fixed in the end part on the deep side in the cassette insertion direction of the lifter shaft 16. One end part of a lifter wire 37 is retained in each winding drum 35.

In the sheet cassette 2, a pulley 38 is rotatably provided in each of upper parts of four corners of the cassette body 15. The other end part of each of the four lifter wires (wires) 37 is fixed to a wire holding portion 39, which is projected from each of the end parts of the four corners of the stacking plate 14, through the pulley 38 rotatably retained in the upper part of the stacking plate 14. On the other hand, in the main body of the deck 50, a coupling 42 of the lifting and lowering device 26 is disposed in a position substantially facing the parallel pin 36 fixed to the end part of the lifter shaft 16. The position of the coupling 42 in the main body of the deck 50 is adjusted such that the coupling 42 engages the parallel pin 36 when the sheet cassette 2 is inserted in the main body of the deck 50. The coupling 42 is coupled to the lift motor 44 that is of the driving source through a gear train 43 provided in the main body of the deck 50.

The controller 25 drives the lift motor 44 when a detector (not illustrated) detects the insertion of the sheet cassette 2 in the main body of the deck 50. The lifter shaft 16 is rotated through the gear train 43 and the coupling 42 to wind the lifter wire 37 about the winding drum 35. As the lifter wire 37 is wound about the winding drum 35, the stacking plate 14 that is hung on the lifter wire 37 through the pulley 38 is lifted while the substantially parallel state is retained.

Figure 7:
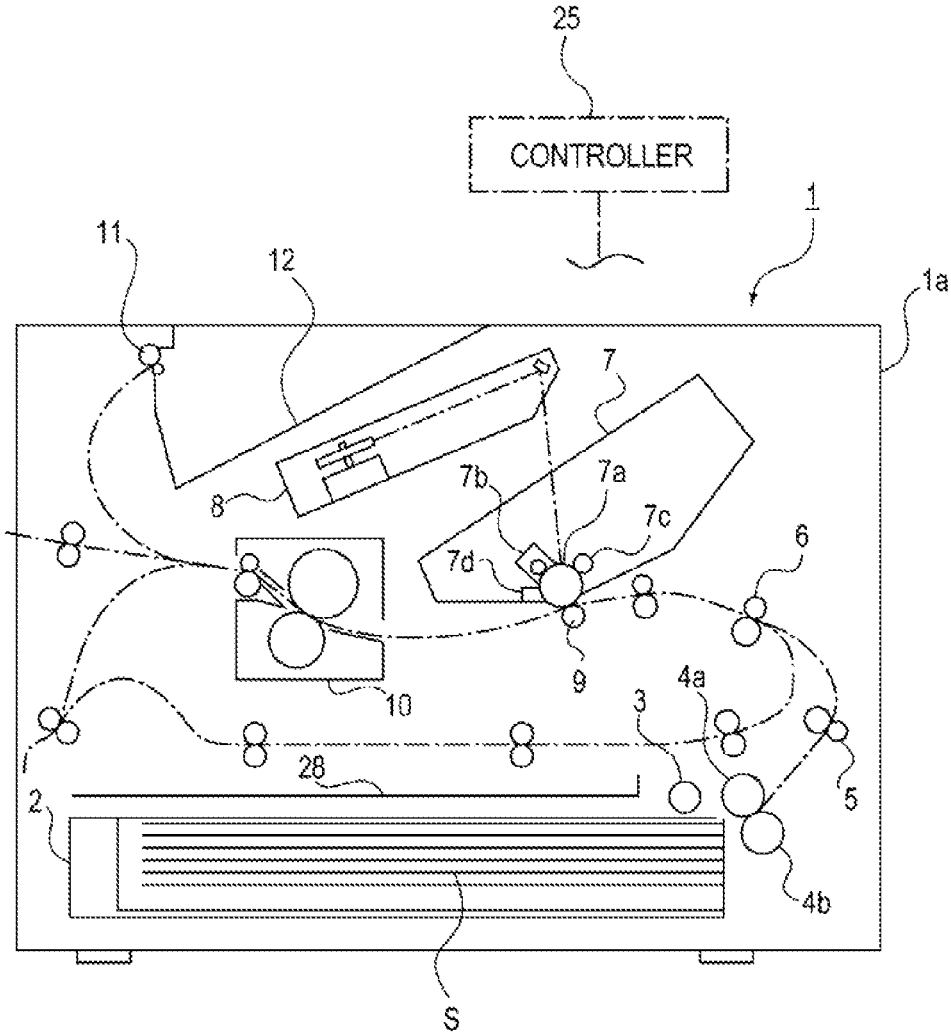
FIG. 7 is a main sectional view illustrating the image forming apparatus of the first embodiment.

The controller 25 rotates the lift motor 44 based on the detection signal from the paper plane sensor (not illustrated) to lift the stacking plate 14 in the direction of the pickup roller 3 (see FIG. 7). Therefore, the stacking plate 14 is lifted to the position in which the proper pressure is applied within a substantially constant range between the upper surface of the sheet supported in feeding and the pickup roller 3.

When the sheet cassette 2 is drawn from the main body of the deck 50, the connection between the parallel pin 36 and the coupling 42 is released, and the stacking plate 14 is lowered to the bottom 15*a* of the sheet cassette 2. A pulley cover 40 is provided in a surrounding of each of the four pulleys 38, and a winding drum cover 41 is provided in a surrounding of each of the four winding drums 35. A gap between the outer circumference of the pulley 38 and the pulley cover 40 and a gap between the outer circumference of the winding drum 35 and the winding drum cover 41 are properly managed such that the lifter wire 37 does not drop out in a winding operation and a rewinding operation of the lifter wire 37.

Figure 12:
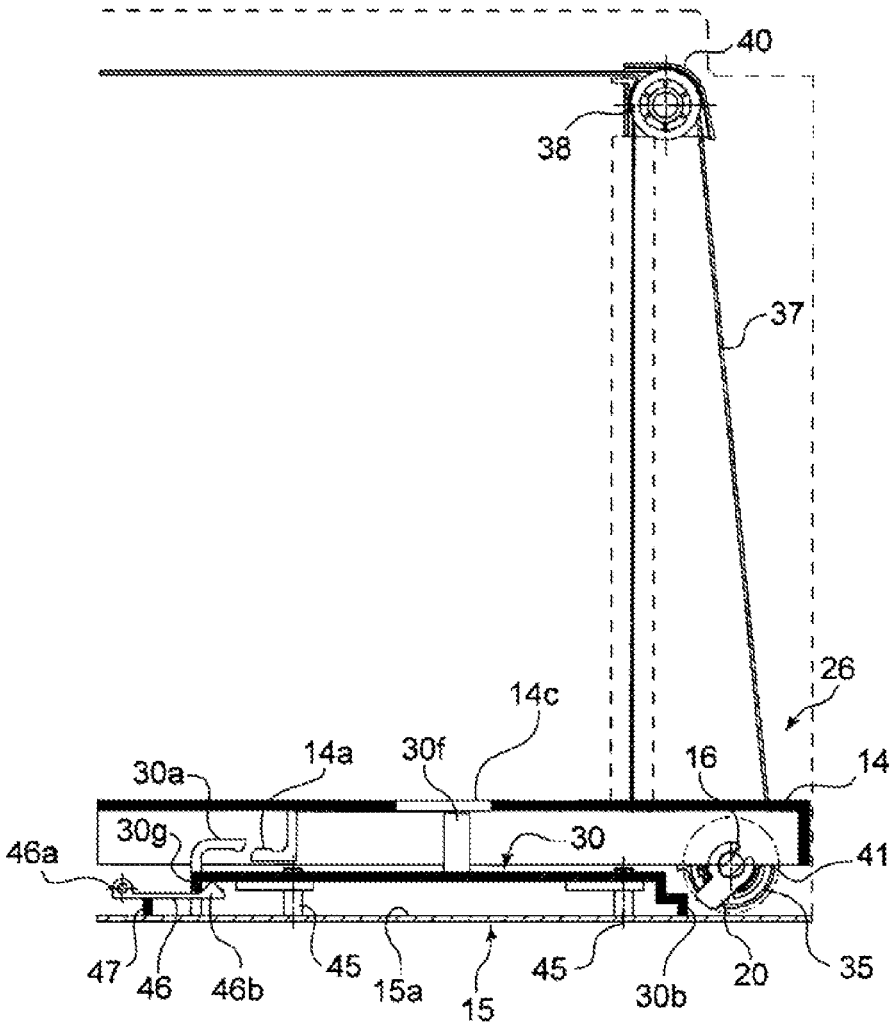
FIG. 12 is a sectional view illustrating a stacking plate lock portion of the third embodiment.
Figure 13:
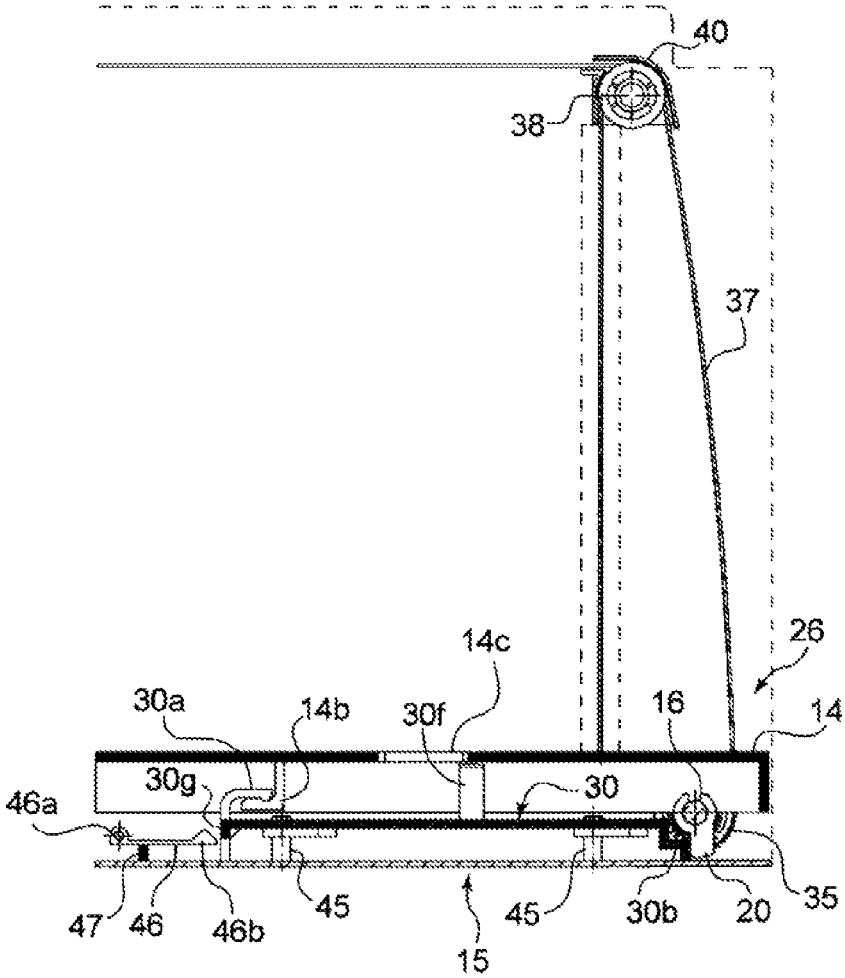
FIG. 13 is a sectional view illustrating the stacking plate lock portion of the third embodiment.
Figure 14:
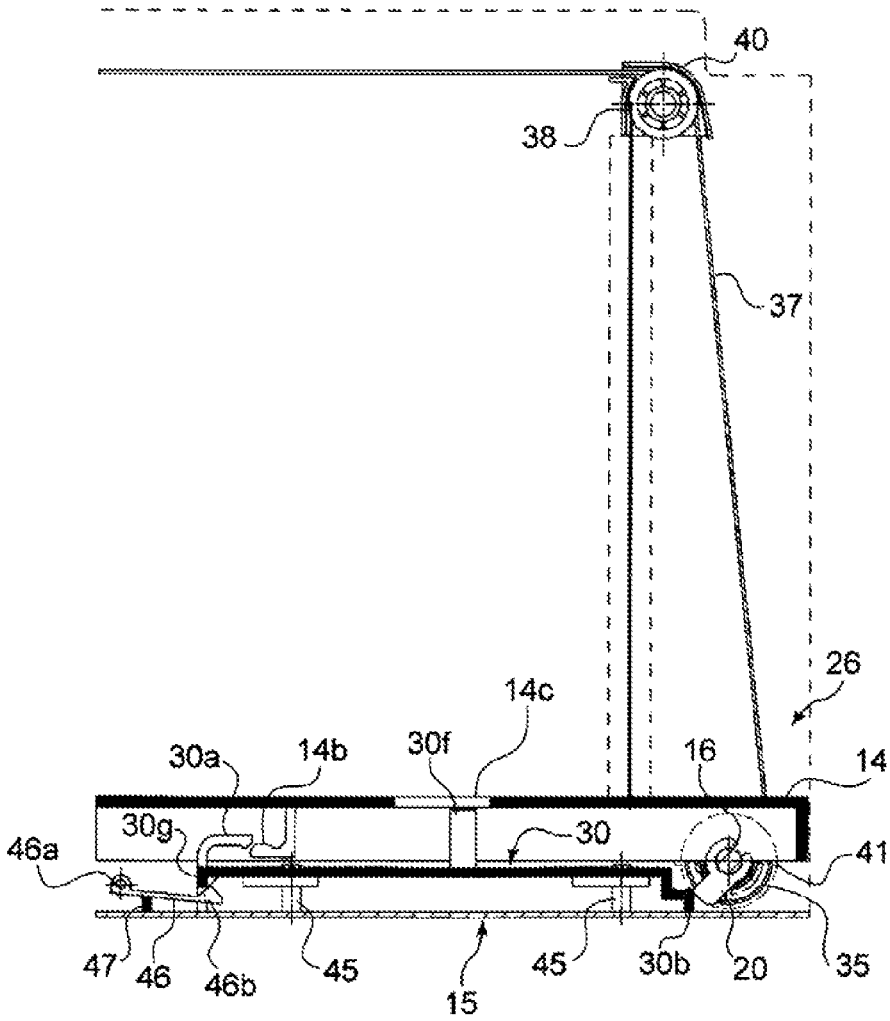
FIG. 14 is a sectional view illustrating the stacking plate lock portion of the third embodiment.

A configuration of the lock lever 30 of the third embodiment and unlocking portion of the lock lever 30 will be described with reference to FIGS. 12 to 14. FIGS. 12 to 14 are sectional views illustrating the configuration of the lock lever 30, FIG. 12 illustrates the state in which the lock lever 30 is located in the unlocked position, and FIG. 13 illustrates the state in which the lock lever 30 is located in the locked position.

The lock lever 30 is a long member in the horizontal direction of FIG. 12. The lock lever 30 is guided by a boss 45 projected from the bottom 15*a* of the cassette body 15 while being movable to right and left of FIG. 12, and the lock lever 30 is retained so as to move in a substantially horizontal direction. An upwardly-projected knob operation portion 30*f* is fixed to the central part in the horizontal direction of the lock lever 30. The lock projection 30*a* having the snap-fit shape is integrally formed in the left end part of lock lever 30, and the abutment portion 30*b* is formed in the right end part. The engagement portion 14*b* that engages the lock projection 30*a* is formed in the position substantially facing the lock projection 30*a* in the rear surface of the stacking plate 14 while being integral with the stacking plate 14. The lock projection 30*a* and the engagement portion 14*b* constitute the holding portion of the invention. Between the winding drums 35 and 35 on the lifter shaft 16, the turning arm 20 is fixed in the position substantially facing the abutment portion 30*b* so as to be turnable along with the lifter shaft 16. The lift motor 44 and the turning arm 20 constitute the actuation portion of the invention.

A latch arm 46 is disposed on the bottom 15*a* in the lower left of the lock lever 30 while being turnable with a turning shaft 46*a* as a supporting point. The latch arm 46 is biased upward by a compression spring 47 that is compressively provided between the latch arm 46 and the bottom 15*a*. In the state of FIG. 12, an inclination surface 46*b* formed at a leading end of the latch arm 46 engages a projection 30*g* in the end part of the lock lever 30 to retain the lock lever 30 in the unlocked position. In the unlocked position, the abutment portion 30*b* at the right end of the lock lever 30 is retracted to the position in which the abutment portion 30*b* does not interfere with the rotation locus of the turning arm 20 fixed to the lifter shaft 16.

In a case when it is necessary to fix the stacking plate 14 before the shipping of the LBP 1 or during the move of the LBP 1, while the sheet cassette 2 is drawn from the apparatus body 1*a* once, the knob operation portion 30*f* is operated by the finger or the tool from the opening 14*c* provided in the stacking plate 14. Therefore, the lock lever 30 is moved onto the right in FIG. 12 against a latch force of the inclination surface 46*b* of the latch arm 46. Accordingly, the abutment portion 30*b* at the right end of the lock lever 30 abuts on the end part of the turning arm 20, and the turning arm 20, the lifter shaft 16, and the winding drum 35 are slightly rotated counterclockwise. The lifter wire 37 slightly winds down by the rotation.

In FIG. 13, the lock lever 30 moves in the right direction to engage the snap-fit shape of the lock projection 30*a* at the left end of the lock lever in the engagement portion 14*b* of the stacking plate 14. Therefore, the rightward movement of the lock lever 30 is regulated while the upward movement of the stacking plate 14 is regulated.

As described above, because the winding drum 35 fixed to the lifter shaft 16 rotates to deliver the lifter wire 37 in association with the rightward movement of the lock lever 30, the lifter wire 37 winds down as illustrated in FIG. 13. However, because of the action of the pulley cover 40 and the winding drum cover 41, the lifter wire 37 does not drop off from a groove of the pulley 38 or the winding drum 35.

When the sheet cassette 2 is inserted while the apparatus body 1*a* is not powered on, the stacking plate 14 is maintained in the locked state, so that the casual movement of the stacking plate 14 can be prevented during the shipment or the move of the apparatus body 1*a*.

When the controller 25 detects the insertion of the sheet cassette 2 after the apparatus body 1*a* and the deck 50 are powered on, the controller 25 rotates the lift motor 44 in the direction in which the stacking plate 14 is lifted. With the rotation of the coupling 42 coupled to the lift motor 44, the parallel pin 36 and the turning arm 20 fixed to the lifter shaft 16 also rotate clockwise. At this point, because the abutment portion 30*b* of the lock lever 30 abuts on the turning arm 20, the lock lever 30 moves in the left direction against a latch force (locking force) by the snap-fit of the lock projection 30*a*.

With the movement of the lock lever 30, the latch arm 46 is pressed down against the spring force of the compression spring 47, the inclination surface 46*b* at the leading end of the latch arm 46 engages the projection 30*g* at the left end in the lower part of the lock lever 30 as illustrated in FIG. 14, and the lock lever 30 is dragged in the left direction by the spring force of the compression spring 47. That is, the shape of the inclination surface 46*b* is formed such that the drag operation is started after the engagement between the lock projection

30*a* and the engagement portion 14*b* is released. Therefore, the lock lever 30 is separated from the turning arm 20, and retained in the unlocked position in which the abutment portion 30*b* retracted from the rotation locus of the turning arm 20 in association with the rotation of the lifter shaft 16.

As described above, in the third embodiment, the lift motor 44, the gear train 43, the coupling 42, the wire holding portion 39, the lifter shaft 16, the turning arm 20, and the winding drum (winding mechanism) 35 constitute the lifting and lowering device 26 that performs the lifting and lowering operation of the stacking plate 14. The winding drum 35 that is of the winding mechanism lifts the stacking plate 14 from the lower position through the lifter wire 37 in association with the turning of the lifter shaft 16. The lifter shaft 16 separates the lock projection 30*a* from the engagement portion 14*b* through the turning arm 20 by the unidirectional turning operation to lift the stacking plate 14 through the winding drum 35, and then the lifter shaft 16 lifts the stacking plate 14. The same effect as the first embodiment can be obtained in the third embodiment in which the large-capacity deck 50 including the lifter wire 37 and the winding drum 35 is used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-075730, filed Mar. 30, 2011, which is hereby incorporated by reference herein in its entirety.

What is claimed is:

1. A sheet feeding apparatus comprising:

a cassette body that is detachably attached to an apparatus body;

a sheet stacking portion, provided in the cassette body, that supports sheets thereon, the sheet stacking portion being able to perform a lifting and lowering operation;

a sheet feeding portion that feeds the sheet stacked on the sheet stacking portion;

a lifting and lowering device that includes a driving source and performs lifting and lowering operations of the sheet stacking portion by driving the driving source;

a controller that controls the driving source;

a locking portion, provided in the cassette body, that can move to a locked position in which the sheet stacking portion is locked in the cassette body and to an unlocked position in which the sheet stacking portion is unlocked, wherein the locking portion engages with the sheet stacking portion at the locked position to lock the stacking portion in the cassette body attached to the apparatus body;

a holding portion that holds the locking portion in the unlocked position; and an actuation portion that moves the locking portion from the locked position to the unlocked position by a driving force of the driving source in order that the locking portion is held by the holding portion in advance of the lifting operation of the sheet stacking portion.

2. The sheet feeding apparatus according to claim 1, wherein the lifting and lowering device includes a turning shaft that turns by receiving the driving force from the driving source and a pushing-up member that pushes up the sheet stacking portion by the turning of the turning shaft, the actuation portion is fixed to the turning shaft, the controller controls the driving source to enables the turning shaft to turn in a first direction and a second direction opposite to the first direction, and the controller controls the driving source to turn the turning shaft in the second direction once before the turning in the first direction so that the actuation portion moves the locking portion to the unlocked position and the holding portion holds the locking portion, and then turns the turning shaft in the first direction to lift the sheet stacking portion through the pushing-up member.

3. The sheet feeding apparatus according to claim 1, wherein the lifting and lowering device includes a turning shaft that turns by receiving the driving force from the driving source and a pushing-up member that pushes up the sheet stacking portion by the turning of the turning shaft, the actuation portion is fixed to the turning shaft, the controller controls the driving source to enables the turning shaft to turn, and the controller controls the driving source to turn the turning shaft so that the actuation portion moves the locking portion to the unlocked position and the holding portion holds the locking portion, and then lifts the sheet stacking portion through the pushing-up member.

4. The sheet feeding apparatus according to claim 3, wherein a time difference is provided between the pushing-up member and an abutment member, which is fixed to the turning shaft so as to turn along with the turning shaft, in order that the pushing-up member lifts the sheet stacking portion after the locking portion is moved to the unlocked position.

5. The sheet feeding apparatus according to claim 3, wherein the holding portion is a toggle spring that holds the locking portion, in which the locking portion is separated from the sheet stacking portion, in the unlocked position.

6. The sheet feeding apparatus according to claim 1, wherein the lifting and lowering device includes a turning shaft that turns by receiving the driving force from the driving source and a winding mechanism that lifts the sheet stacking portion through a wire by the turning of the turning shaft, the actuation portion is fixed to the turning shaft so as to turn along with the turning shaft, the controller controls the driving source to enables the turning shaft to turn, and the controller controls the driving source to turn the turning shaft so that the actuation portion moves the locking portion to the unlocked position and the holding portion holds the locking portion, and then lifts the sheet stacking portion through the winding mechanism.

7. An image forming apparatus comprising:

a cassette body that is detachably attached to an apparatus body;

a sheet stacking portion, provided in the cassette body, that supports sheet thereon, the sheet stacking portion being able to perform a lifting and lowering operation;

a sheet feeding portion that feeds the sheet stacked on the sheet stacking portion;

a lifting and lowering device that includes a driving source and performs lifting and lowering operations of the sheet stacking portion by driving the driving source;

a controller that controls the driving source;

a locking portion, provided in the cassette body, that can move to a locked position in which the sheet stacking portion is locked in the cassette body and to an unlocked position in which the sheet stacking portion is unlocked, wherein the locking portion engages with the sheet stacking portion at the locked position to lock the stacking portion in the cassette body attached to the apparatus body;

a holding portion that holds the locking portion in the unlocked position;

an actuation portion that moves the locking portion from the locked position to the unlocked position by a driving force of the driving source in order that the locking portion is held by the holding portion in advance of the lifting operation of the sheet stacking portion; and an image forming portion that forms an image in the sheet fed by the sheet feeding portion.

8. The image forming apparatus according to claim 7, wherein the lifting and lowering device includes a turning shaft that turns by receiving the driving force from the driving source and a pushing-up member that pushes up the sheet stacking portion by the turning of the turning shaft, the actuation portion is fixed to the turning shaft, the controller controls the driving source to enables the turning shaft to turn in a first direction and a second direction opposite the first direction, and the controller controls the driving source to turn the turning shaft in the second direction once before the turning in the first direction so that the actuation portion moves the locking portion to the unlocked position and the holding portion to hold the locking portion, and then turns the turning shaft in the first direction to lift the sheet stacking portion through the pushing-up member.

9. The image forming apparatus according to claim 7, wherein the lifting and lowering device includes a turning shaft that turns by receiving the driving force from the driving source and a pushing-up member that pushes up the sheet stacking portion by the turning of the turning shaft, the actuation portion is fixed to the turning shaft, the controller controls the driving source to enables the turning shaft to turn, and the controller controls the driving source to turn the turning shaft so that the actuation portion moves the locking portion to the unlocked position and the holding portion to hold the locking portion, and then lifts the sheet stacking portion through the pushing-up member.

10. The image forming apparatus according to claim 9, wherein a time difference is provided between the pushing-up member and an abutment member, which is fixed to the turning shaft so as to turn along with the turning shaft, in order that the pushing-up member lifts the sheet stacking portion after the locking portion is moved to the unlocked position.

11. The image forming apparatus according to claim 9, wherein the holding portion is a toggle spring that holds the locking portion, in which the locking portion is separated from the sheet stacking portion, in the unlocked position.

12. The image forming apparatus according to claim 7, wherein the lifting and lowering device includes a turning shaft that turns by receiving the driving force from the driving source and a winding mechanism that lifts the sheet stacking portion through a wire by the turning of the turning shaft, the actuation portion is fixed to the turning shaft so as to turn along with the turning shaft, the controller controls the driving source to enables the turning shaft to turn, and the controller controls the driving source to turn the turning shaft so that the actuation portion moves the locking portion to the unlocked position and the holding portion to hold the locking portion, and then lifts the sheet stacking portion through the winding mechanism.

* * * * *